US010267583B2

(12) United States Patent
Murphy, II et al.

(10) Patent No.: US 10,267,583 B2
(45) Date of Patent: Apr. 23, 2019

(54) FIREARM GRIP WITH SELECTOR SWITCH LOCK

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

(73) Assignee: Gun Guardian LLC, Orlando, FL (US)

( * ) Notice: Subject to any disclaimer, the term of this patent is extended or adjusted under 35 U.S.C. 154(b) by 2 days.

(21) Appl. No.: 15/484,795

(22) Filed: Apr. 11, 2017

(65) Prior Publication Data

US 2017/0219306 A1 Aug. 3, 2017

Related U.S. Application Data

(63) Continuation-in-part of application No. 15/261,279, filed on Sep. 9, 2016, now Pat. No. 9,784,516, which is a continuation-in-part of application No. 14/885,394, filed on Oct. 16, 2015, now abandoned.

(60) Provisional application No. 62/322,339, filed on Apr. 14, 2016.

(51) Int. Cl.

| | |
|---|---|
| ***F41A 17/20*** | (2006.01) |
| ***F41C 23/10*** | (2006.01) |
| ***F41A 17/06*** | (2006.01) |
| ***F41C 23/16*** | (2006.01) |

(52) U.S. Cl.

CPC ..... *F41A 17/20* (2013.01); *F41A 17/063* (2013.01); *F41A 17/066* (2013.01); *F41C 23/10* (2013.01); *F41C 23/16* (2013.01)

(58) Field of Classification Search

CPC ..... F41A 17/06; F41A 17/063; F41A 17/066; F41A 17/20; F41A 17/62; F41A 17/70; F41A 17/80

See application file for complete search history.

(56) References Cited

U.S. PATENT DOCUMENTS

| | | | |
|---|---|---|---|
| 2,115,041 A | 4/1938 | Obregon | |
| 4,775,176 A | 10/1988 | Ikeda | |
| 6,240,669 B1 | 6/2001 | Spanish et al. | |
| 9,658,017 B2 * | 5/2017 | Alicea | F41A 19/59 |

(Continued)

FOREIGN PATENT DOCUMENTS

| | | |
|---|---|---|
| EP | 1058081 | 12/2000 |

*Primary Examiner* — Stephen Johnson

(74) *Attorney, Agent, or Firm* — Jason T. Daniel, Esq.; Daniel Law Offices, P.A.

(57) ABSTRACT

A firearm grip with selector switch lock includes a handgrip for engaging a firearm receiver having a selector switch. A switch engagement unit is positioned within the handgrip. The switch engagement unit including a motor, piston, spring and detent for selectively engaging the selector switch of the receiver to which the handgrip is located. An RFID interrogator is positioned within the handgrip and communicates with a portable RFID chip. Upon detecting the presence of the RFID chip, the switch engagement unit moves the piston to the retracted position for manual free operation of the selector switch. Upon detecting the RFID chip is not within the proximity of the handgrip, the switch engagement unit moves the piston to the extended/SAFE position. A replacement selector switch having a torque limiter is provided.

20 Claims, 9 Drawing Sheets

(56) References Cited

U.S. PATENT DOCUMENTS

2009/0255160 A1* 10/2009 Summers ..... F41A 17/063
42/70.01
2015/0253093 A1* 9/2015 Allan ..... F41A 17/46
42/70.06

* cited by examiner

FIREARM GRIP WITH SELECTOR SWITCH LOCK

CROSS-REFERENCE TO RELATED APPLICATIONS

This application claims the benefit of U.S. Application Ser. No. 62/322,339 filed on Apr. 14, 2016, and is a continuation in part to application Ser. No. 15/261,279, now U.S. Pat. No. 9,784,516, filed on Sep. 9, 2016, which is a continuation in part of U.S. patent application Ser. No. 14/885,394, having an original priority date of Oct. 16, 2015, the contents of each of which are incorporated herein by reference.

TECHNICAL FIELD

The present invention relates generally to firearm safety devices, and more particularly to a firearm grip having an internally located selector switch locking mechanism.

BACKGROUND

The statements in this section merely provide background information related to the present disclosure and may not constitute prior art.

As any responsible firearm owner will attest, firearms should always remain locked when they are not in use, so as to prevent an accidental discharge of the same and/or to prevent access by an unauthorized individual. As such, there are many known types of commercially available firearm locking mechanisms such as trigger guards and/or trigger locks, for example which can be secured along or about the external portion of the firearm trigger to prevent access to the same.

Although useful in their inception, these devices suffer from several drawbacks. For example, because these locking mechanisms are externally mounted, it is not uncommon for one or more pieces of the lock to become lost when the same is not secured onto the weapon. Additionally, it is not uncommon for users to secure the lock onto the weapon incorrectly, thereby causing a situation where unauthorized access can occur. Finally, the time required to correctly secure and/or physically remove the external lock may be unacceptable in emergency situations where the user needs immediate access to the weapon.

For these reasons, many individuals forego such devices and instead store the weapon with the integrated selector switch at SAFE. Although the selector switch does work well to prevent an inadvertent discharge of the firearm, it does nothing to prevent an unauthorized user from firing the weapon by transitioning the switch from SAFE to FIRE.

The present invention, directed to a firearm with selector switch lock differs from the conventional art in a number of aspects. The manner by which will become more apparent in the description which follows, particularly when read in conjunction with the accompanying drawings.

SUMMARY OF THE INVENTION

The present invention is directed to a firearm grip with selector switch lock. One embodiment of the present invention can include a handgrip for engaging a firearm receiver having a Fire/Safe selector switch. A switch engagement unit can be positioned within the handgrip. The switch engagement unit including a motor, piston, spring and detent for selectively engaging the selector switch of the receiver to which the handgrip is located. When the piston is in the retracted position, the device does not affect the operation of the selector switch, and the same can be manually transitioned between the SAFE and FIRE positions. When the piston is in the extended position, the detent secures the selector switch in the SAFE position.

Another embodiment of the present invention can include a user authentication unit in the form of an RFID interrogator and portable RFID chip. Upon detecting the presence of the RFID chip, the user authentication unit can position the engagement unit in the retracted position. Conversely, when the RFID chip is not within the proximity of the handgrip, the unit can position the engagement unit in the extended/SAFE position.

Yet another embodiment of the present invention can include a replacement selector switch having a torque limiter. The torque limiter can function to prevent an excessive manual force applied onto the selector switch from disabling the engagement unit.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
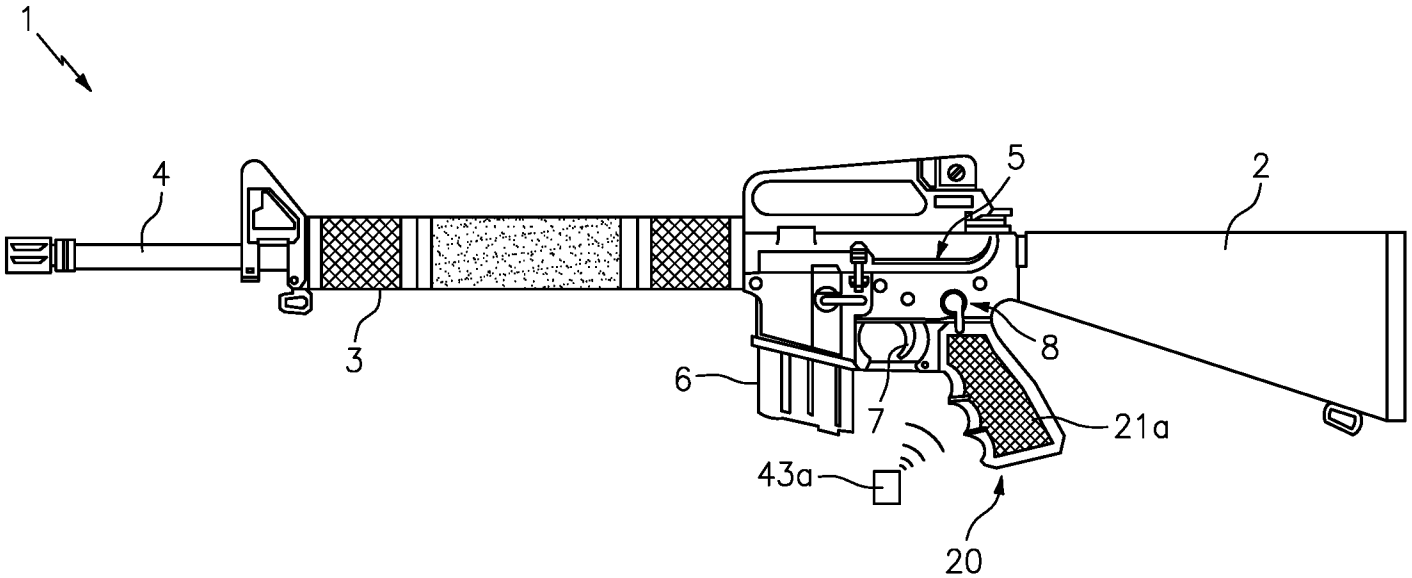
FIG. 1 is a side view of an illustrative firearm locking device coupled to a firearm, in accordance with one embodiment.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

FIGS. 1-5C illustrate various embodiments of a firearm grip with selector switch locking device 20 that are useful for understanding the inventive concepts disclosed herein. Throughout the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As will be described below, the inventive concepts include a firearm locking device. Although illustrated in use with a long gun, such as an AR-15 rifle, for example, this is but one possible implementation. To this end, the inventive concepts described herein can be used and/or adapted for use with any other type of firearm without undue experimentation and without departing from the invention claimed. Accordingly, the presently claimed invention is not to be construed as limiting to any particular type or brand of firearm device.

FIG. 1 is an illustrative firearm 1 for use with the locking device 20. The firearm including a buttstock 2, a handguard 3, a barrel 4, and a receiver 5. A magazine 6, a trigger assembly 7, an integrated selector/safety 8, and the below described locking device 20 are supported by the receiver body 5.

Figure 2A:
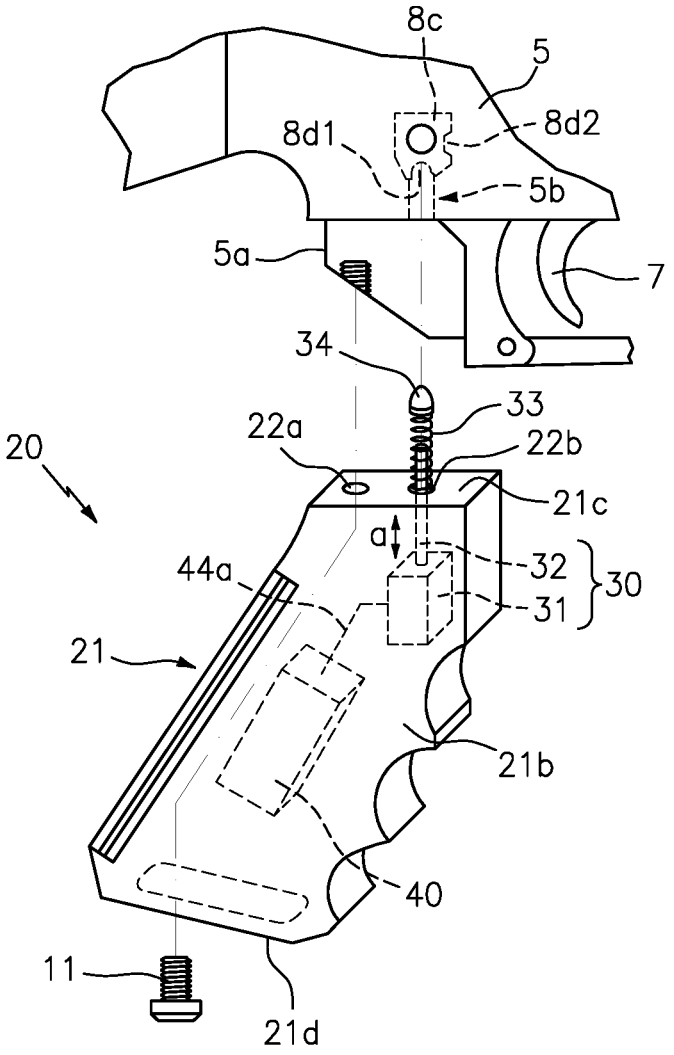
FIG. 2A is a detailed view of FIG. 1, showing the mounting of the illustrative firearm locking device to the receiver body of the firearm.

As shown in FIG. 2A, the firearm locking device 20 can include, essentially, a hand grip 21, a switch engagement unit 30, and a control system 40.

As described herein, the hand grip 21 can include an elongated generally hollow and tubular-shaped member having a left side portion 21*a*, a right side portion 21*b* a top end 21*c* and a bottom end 21*d*. The hand grip may be formed from materials that are, for example, relatively strong and stiff for their weight. Several nonlimiting examples include, but are not limited to various metals or metal alloys (e.g., aluminum, steel, titanium, or alloys thereof), a plastic/polymer (e.g., high-density polyethylene (HDPE) or polyethylene terephthalate (PET)), and/or a composite material (e.g., carbon fibers in a polymer matrix, fiberglass, etc.).

The hand grip 21 can include a shape and size that is designed to replace the manufacturer-supplied hand grip of a firearm by use of conventional fastener(s) such as a machine screw 11, for example that can be conventionally secured within the lower receiver mounting tab 5*a* of the receiver 5. To this end, the hand grip 21 can include any number of openings 22*a* and 22*b*, for example, that can be disposed at locations identical to those found on a stock grip. Although described as a replacement grip, those of skill in the art will recognize that the device 20 can be incorporated into the new construction of a firearm 1, so as to impart the inventive concepts disclosed herein as a factory component.

The switch engagement unit 30 can function to selectively engage the selector switch 8 of the firearm to which the locking device 20 is attached. The switch engagement unit 30 can include a motor 31 that extends and retracts an elongated piston 32, as shown by arrow a. The piston is positioned within the coils of a spring 33 having a detent 34 along a distal end. As shown in FIG. 2A, the motor 31 can be secured within the interior portion of the hand grip 21 and the piston 32 can traverse opening 22*b* which is located directly beneath the receiver channel 5*b* leading to one end of the selector switch 8. In the preferred embodiment, the motor and piston can comprise a dc powered linear actuator capable of imparting 5 pounds of pressure onto the detent 34. One nonlimiting example of a suitable linear actuator includes the model: PA-07 linear actuator that is commercially available from Progressive Automations. Of course, any number of other devices capable of selectively engaging the detent of the firearm in the manner described below are also contemplated. Such other devices can be capable of imparting pressures greater than, or less than that described herein.

As will be described below, when the unit 30 is in the unlocked/retracted position, the selector switch 8 of the firearm can operate in the expected manner so as to be manually transitioned between the SAFE and FIRE positions. Conversely, when the engagement unit 30 is in the locked/extended position, the selector switch will be secured in the SAFE position.

Figure 2B:
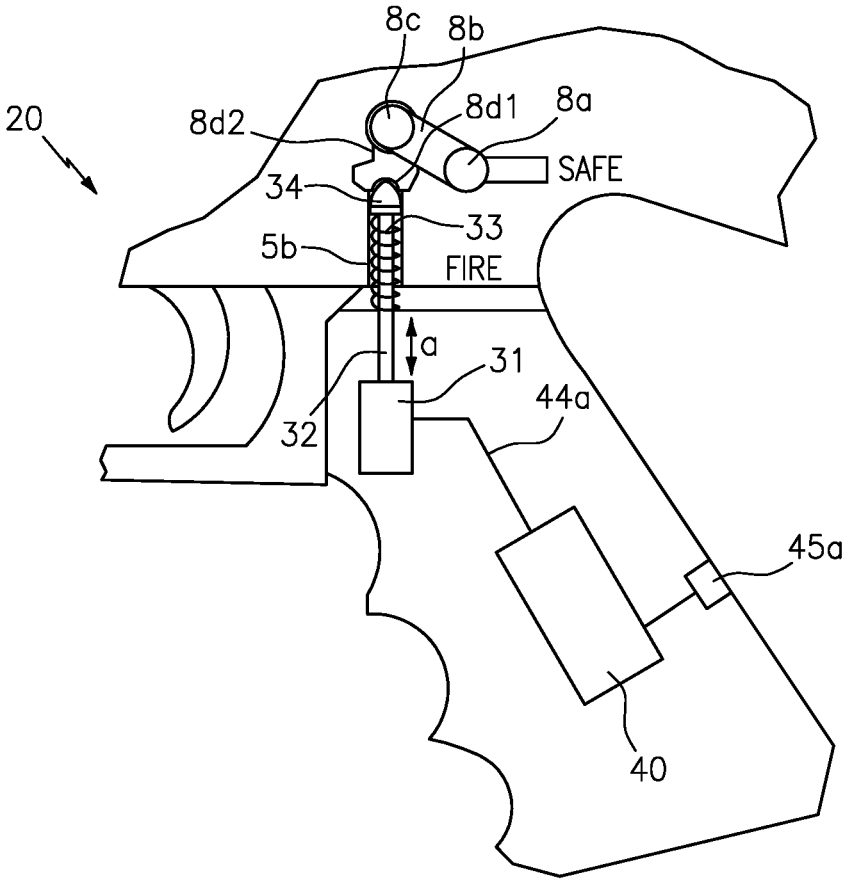
FIG. 2B is another detailed view of FIG. 1, showing the mounting of the illustrative firearm locking device to the receiver body of the firearm.

To this end, FIG. 2B illustrates one embodiment of the firearm locking device 20 wherein the hand grip 21 is secured onto the receiver 5, so as to position the spring 33, detent 34 and distal portion of the piston 32 within the channel 5*b* of the receiver.

As is known to those of skill in the art, the selector switch 8 of a rifle such as the illustrated AR-15, for example, includes a first end 8*a* in the form of a thumb lever that is positioned on the outside (typically on the left side) of the receiver body. The thumb lever is connected to an elongated notched-cylindrical member 8*b* that extends across the receiver body and terminates into a contoured second end 8*c*. As described below, the second end of the selector switch includes a transverse groove 8*d* having a dimple 8*d*1 and 8*d*2 along each end. These dimples 8*d*1 and 8*d*2 corresponding with the SAFE and FIRE position of the thumb lever 8*a*, respectively.

Figure 3A:
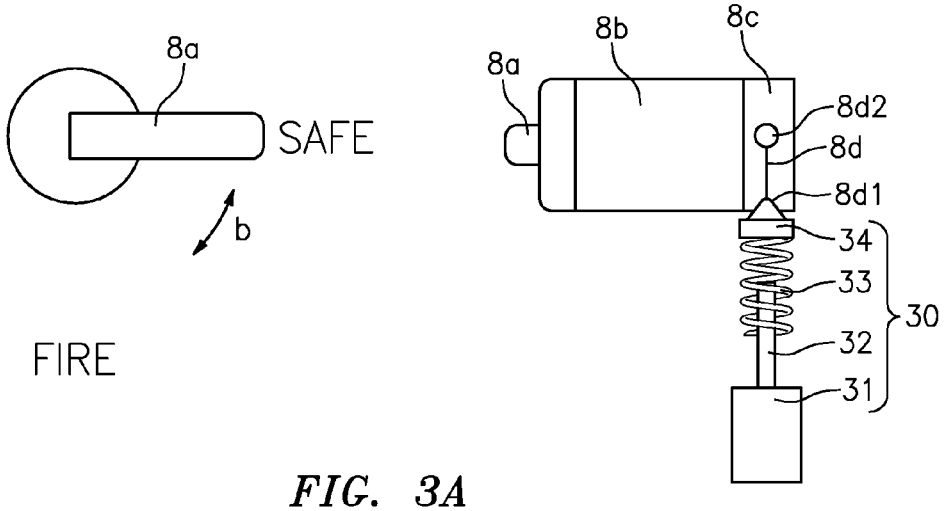
FIG. 3A is an exemplary cutout view of the operation of the illustrative firearm locking device in the retracted position when the selector switch is in the SAFE position.
Figure 3B:
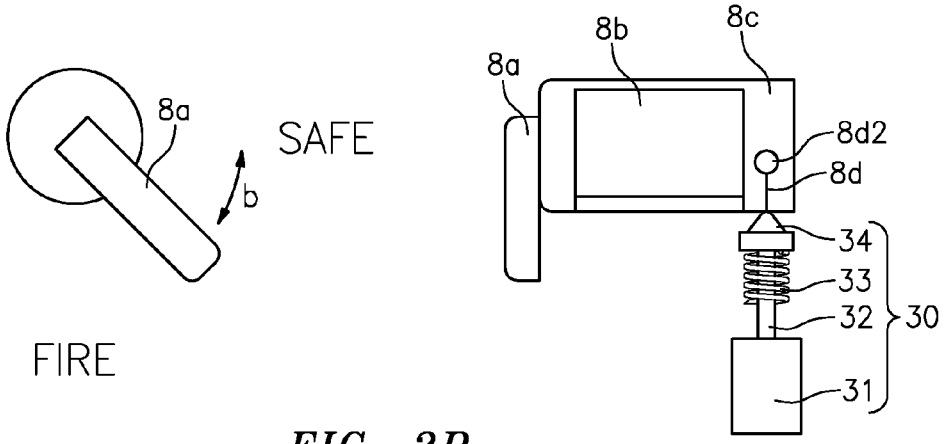
FIG. 3B is an exemplary cutout view of the operation of the illustrative firearm locking device in the retracted position when the selector switch is transitioning between the SAFE and FIRE position.
Figure 3C:
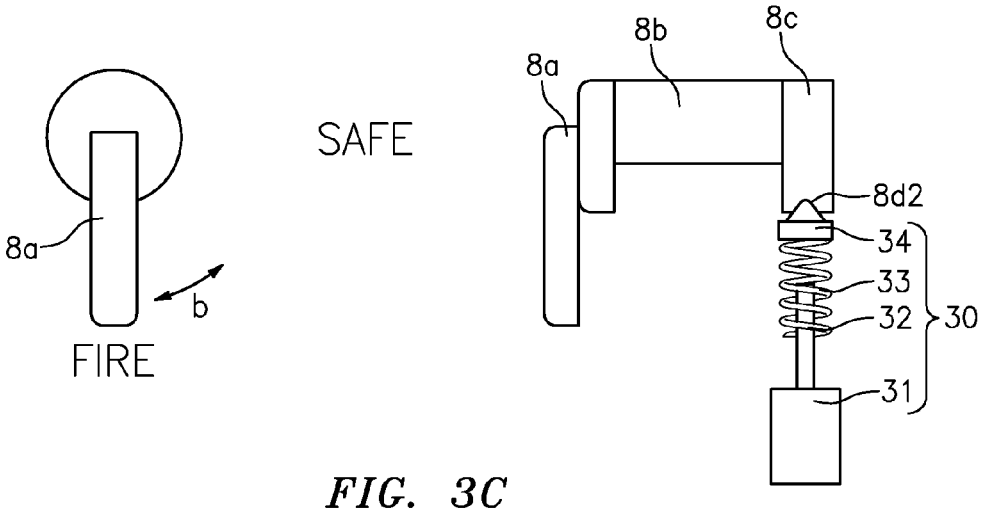
FIG. 3C is an exemplary cutout view of the operation of the illustrative firearm locking device in the retracted position when the selector switch is in the FIRE position.

Cutout FIGS. 3A-3G are provided to illustrate an exemplary operation of the switch engagement unit 30 as it engages the selector switch. As such, the remaining components are omitted for ease of illustration. As shown in FIGS. 3A-3C, when the engagement unit is in the unlocked/retracted position, the piston 32 does not make physical contact with the detent 34. As such, the spring 33 and detent 34 move freely within the receiver channel to impart a constant and light upward force onto the groove 8*d* and dimples 8*d*1 and 8*d*2 of the switch. This force acts in the conventional manner so as to maintain the switch in either the SAFE or FIRE position until the thumb lever 8*a* is moved by a user (see arrow b). In this regard, when the engagement unit 30 is in the unlocked/retracted position, the operation of the firearm selector switch 8 is not affected by the device 20.

Figure 3D:
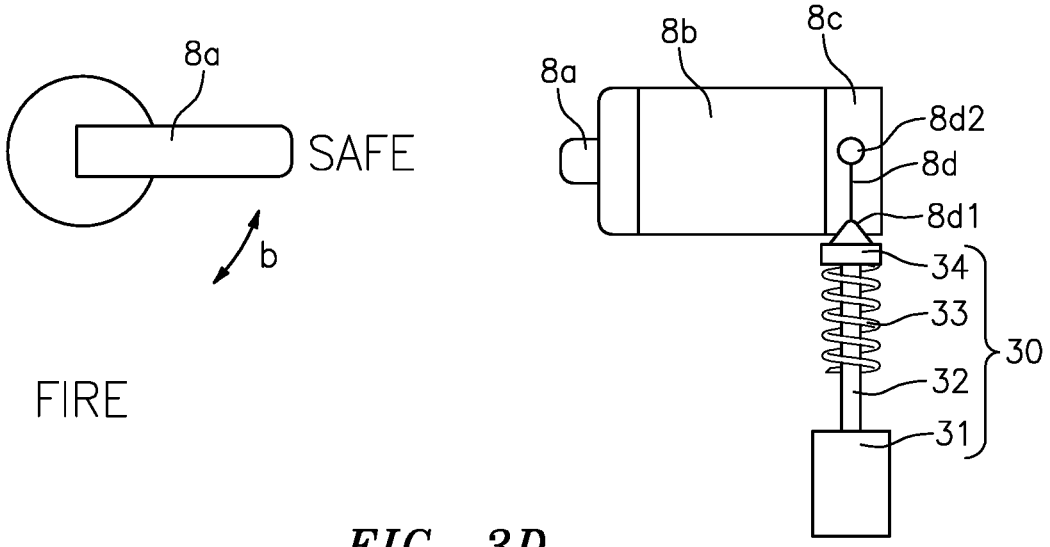
FIG. 3D is an exemplary cutout view of the operation of the illustrative firearm locking device in the extended position when the selector switch is in the SAFE position.

Cutout FIG. 3D illustrates one embodiment of the engagement unit 30 in the locked/extended position. As shown, when the engagement unit is activated with the firearm in the SAFE position, the piston 32 will move upward (see arrow c) through the spring 33 until making contact with the detent 34 and forcing the detent into the dimple 8*d*1, with sufficient pressure to prevent a user from manually changing the position of the selector switch to FIRE via the thumb lever 8*a*.

Figure 3E:
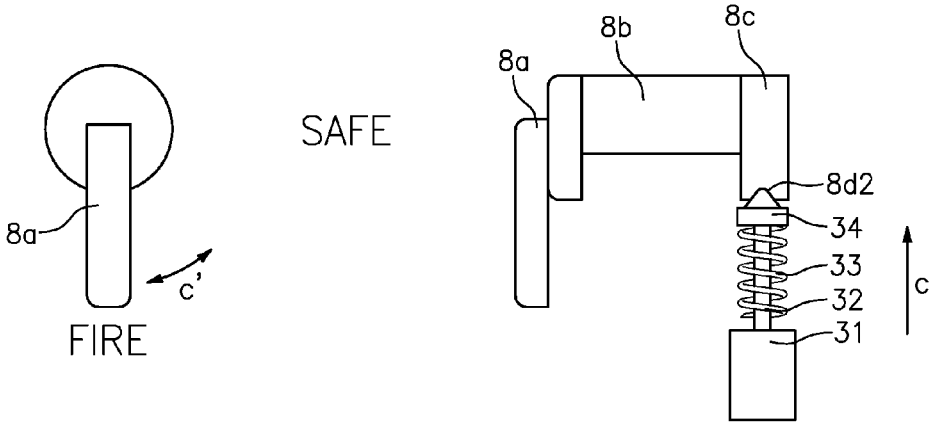
FIG. 3E is an exemplary cutout view of the operation of the illustrative firearm locking device in the extended position when the selector switch is in the FIRE position.
Figure 3F:
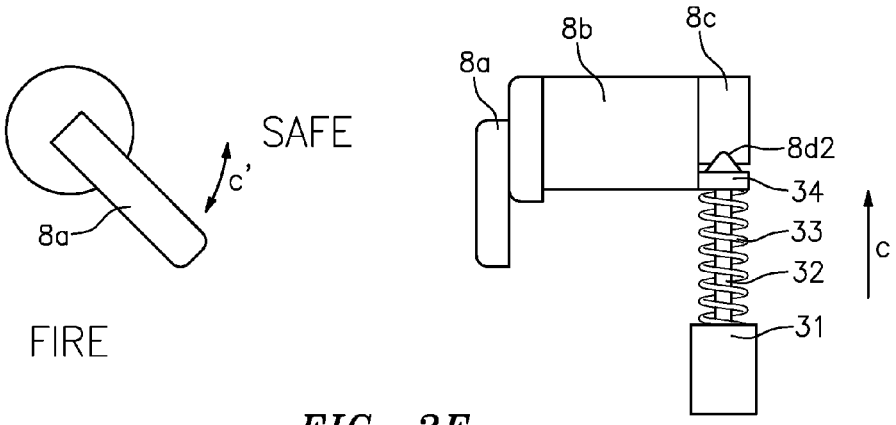
FIG. 3F is an exemplary cutout view of the operation of the illustrative firearm locking device in the extended position moving the selector switch from the FIRE position to the SAFE position.
Figure 3G:
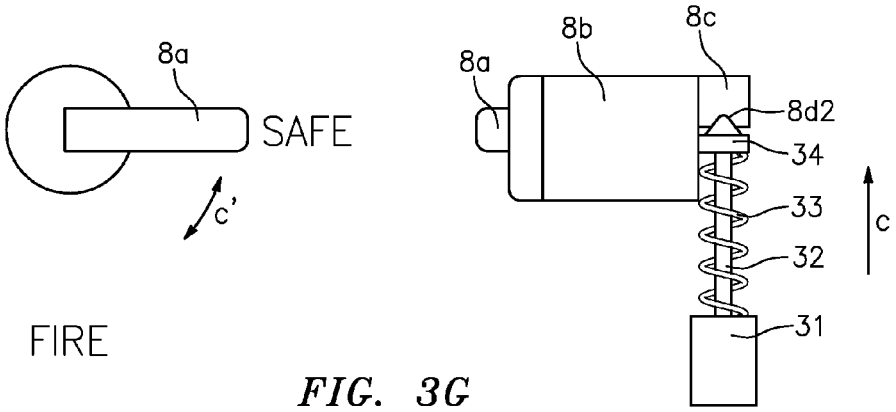
FIG. 3G is an exemplary cutout view of the operation of the illustrative firearm locking device in the extended position after moving the selector switch to the SAFE position.

Next, cutout FIGS. 3E-3G illustrate one embodiment of the engagement unit transitioning the weapon from the FIRE position to the SAFE position upon being activated. As shown, when the motor 31 of the engagement unit is activated with the weapon in the FIRE mode, the piston 32 will move upward (see arrow c) through the spring 33 until making contact with the detent 34. The piston will push the detent 34 into dimple 8*d*1, and will continue the movement, thereby rotating the safety (see arrow c') from FIRE to SAFE. This is possible owing to the known irregular shape of the firing pin, and the locations of the dimples 8*d*1 and 8*d*2 thereon. As such, when the piston is fully extended, the detent 34 will remain in contact with the dimple 8*d*2, but the firearm safety and thumb lever will be locked in the SAFE position, until the engagement unit is retracted.

In the preferred embodiment, the upward force applied by the engagement unit can be between approximately 2 and 5 pounds of pressure. Such pressure has been shown through tests to be sufficient to transition the selector switch of an AR-15 rifle from FIRE to SAFE, as described above, and to prevent manual movement of the switch by an adult, without the aid of a mechanical advantage (e.g., external tools). Of course, other embodiments are contemplated wherein different amounts of force/pressure can be applied onto the firearm selector switch, based on the make/manufacturer of the firearm to be used with the device 20. In either instance, when the unit 30 is in the locked position, a user is unable to transition the selector switch of the weapon from SAFE to FIRE.

Figure 4:
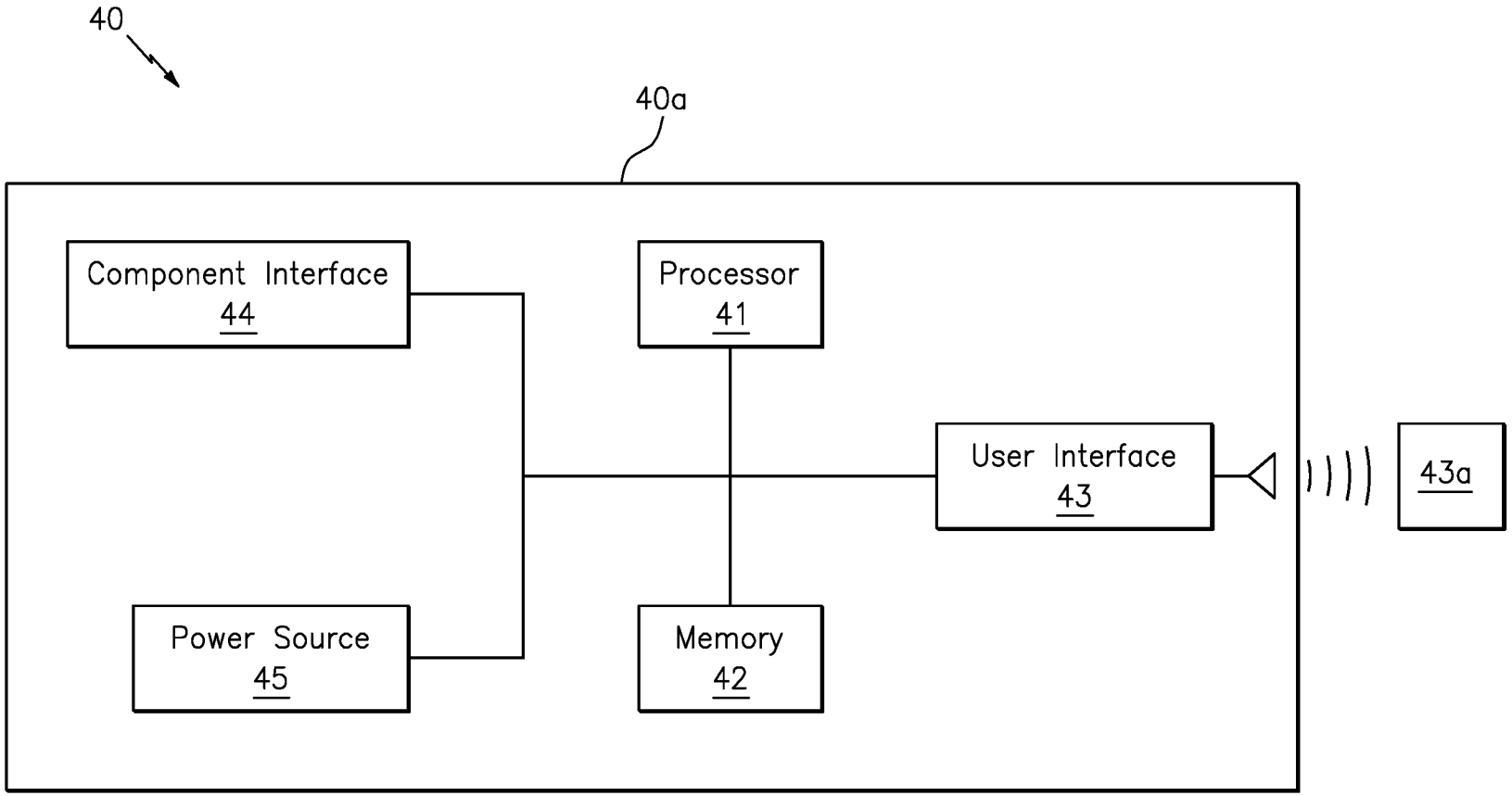
FIG. 4 is a simplified block diagram of the control system of the illustrative firearm locking device.

FIG. 4 illustrates one embodiment of a control system 40 which can function to authenticate a user's identity and control an operation of the switch engagement unit 30. In one embodiment, the control system can include an outer shell/body 40*a* having a processor 41 that is conventionally connected to an internal memory 42, a user interface 43, an internal component interface unit 44, and/or a power source 45.

Although illustrated as separate elements, those of skill in the art will recognize that one or more system components may comprise, or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of, or in conjunction with the below described controller elements.

The main body 40*a* can include any number of different shapes and sizes, and can be constructed from any number of different materials suitable for encompassing each of the controller elements. In one preferred embodiment, the main body 40*a* can be constructed from lightweight injection molded plastic having a plurality of internal connectors (not shown) for securely housing each of the device elements. Of course, any number of other known construction materials such as PVC and composites, for example, are also contemplated.

The processor/CPU 41 can act to execute program code stored in the memory 42 in order to allow the device to perform the functionality described herein. Processors are extremely well known in the art, therefore no further description will be provided.

Memory 42 can act to store operating instructions in the form of program code for the processor 41 to execute. Although illustrated in FIG. 4 as a single component, memory 42 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device such as a hard drive, for example. Additionally, memory 42 can also include one or more cache memories that provide temporary storage of at least some program code in order to reduce the number of times program code must be retrieved from the bulk storage device during execution. Each of these devices are well known in the art.

The user interface 43 can include any number of different components that are capable of sending and/or receiving information with an external device or a user. In the preferred embodiment, the user interface 43 can include, control or comprise an RFID system having an RFID interrogator that can communicate with an externally located RFID tag 43*a*. To this end, the RFID tag 43*a* can include any number of different shapes and sizes, and/or can be embedded within a secondary object such as a keychain, bracelet or ring, for example. As will be known to those of skill in the art, an RFID interrogator can function to send and/or receive data with the integrated circuit of an RFID tag that is located nearby.

Of course, the user interface is not limited to the use of an RFID system, as any number of other known systems capable of receiving and/or verifying a user are also contemplated. Several nonlimiting examples include a biometric authentication unit having a fingerprint sensor, and/or the use of a combination lock with inputs for receiving a pre-programmed combination of numbers or letters, for example.

The internal component interface unit 44 can function to provide a communicative link between the processor 41 and various other device components such as the switch engagement unit 30, the user interface 43, and/or the charging port 45*a*, for example. In this regard, the component interface unit can include any number of different components such as one or more PIC microcontrollers, internal bus 44*a*, USB connections and other such hardware capable of providing a direct link between the various components. Of course any other means for providing the two way communication between the device components can also be utilized herein.

In one preferred embodiment, the power source 45 can include one or more DC batteries capable of providing the necessary power requirements to each element of the device 10. In one embodiment, the batteries can be permanently located within the hand grip 21 and can be rechargeable in nature via a charging port 45*a*, such as a mini or micro USB port, for example. Of course, traditional batteries can also be utilized and the main body can further include a battery compartment having a removable cover (not illustrated) for allowing a user to access the same.

In operation, the resting state of the device will be with the engagement unit 30 in the locked/extended position of FIG. 3D, so as to maintain the weapon in the SAFE fire position. When the user interface 43 detects the presence of the RFID tag 43*a*, the processor can instruct the engagement unit 30 to transition to the unlocked/retracted position of FIGS. 3*a*-3C, so as to allow manual operation of the selector switch 8 for so long as the tag 43*a* is detected. As such, when the user interface 43 detects that the RFID tag 43*a* is not nearby, the processor can instruct the engagement unit 30 to transition to the locked/extended position of FIGS. 3E-3G, thereby automatically transitioning the firearm to the SAFE position.

Figure 5A:
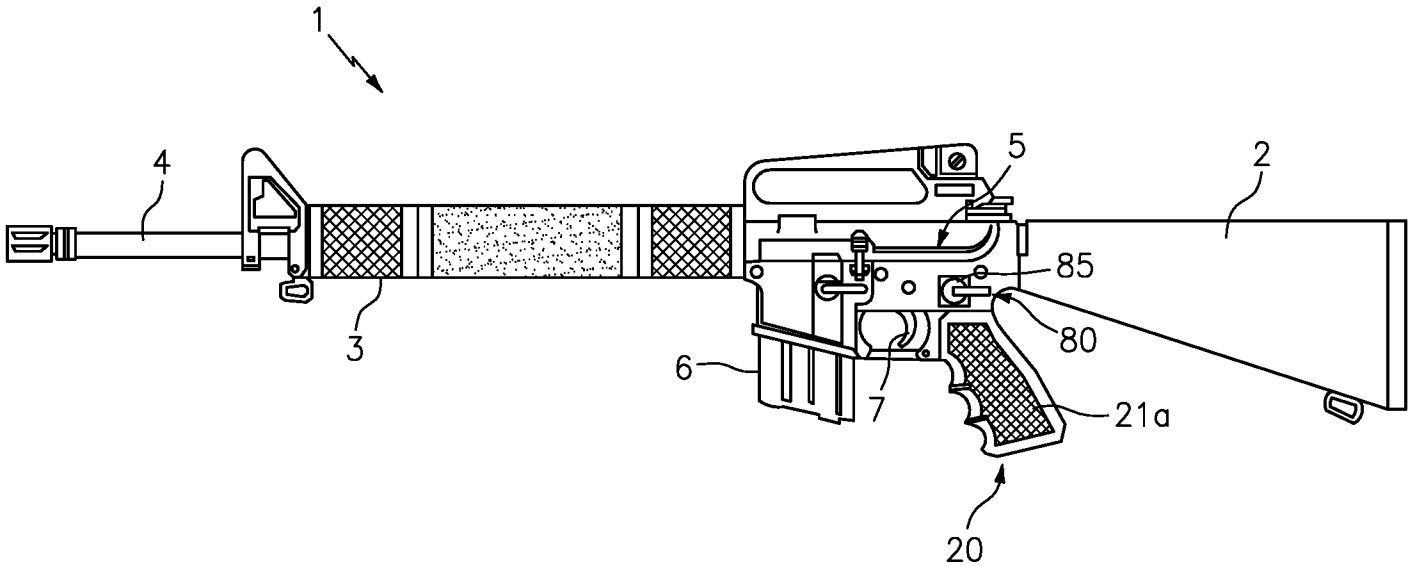
FIG. 5A is a side view of an illustrative firearm locking device coupled to a firearm, in accordance with another embodiment.

As noted above, it is contemplated that an unauthorized user could attempt to circumvent and/or break the engagement unit 30 of the firearm locking device 20 by applying excessive downward force (e.g., greater than 5 pounds) onto the thumb lever of the selector switch 8. In order to prevent such a situation, FIG. 5A illustrates another embodiment of the firearm locking device 20 that includes a replacement selector switch 80 having an integrated torque limiter 85.

Figure 5B:
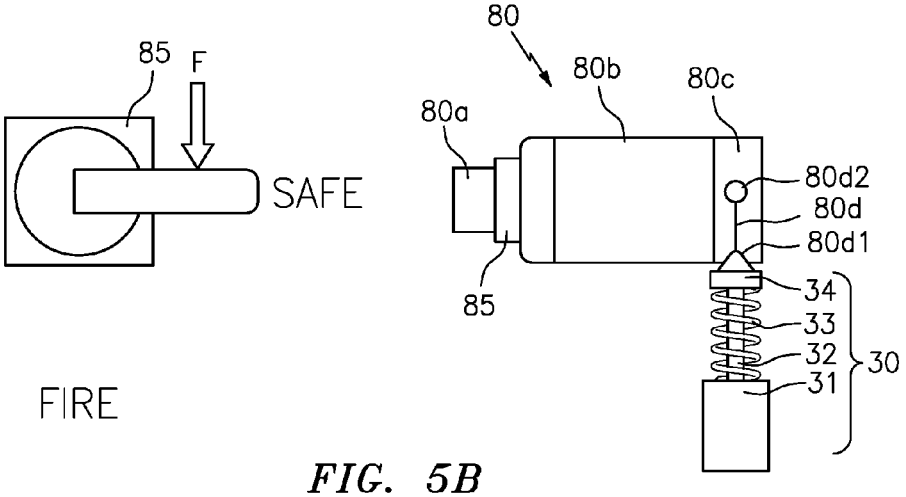
FIG. 5B is an exemplary cutout view of the operation of the replacement selector switch of the illustrative firearm locking device in operation, in accordance with the another embodiment.
Figure 5C:
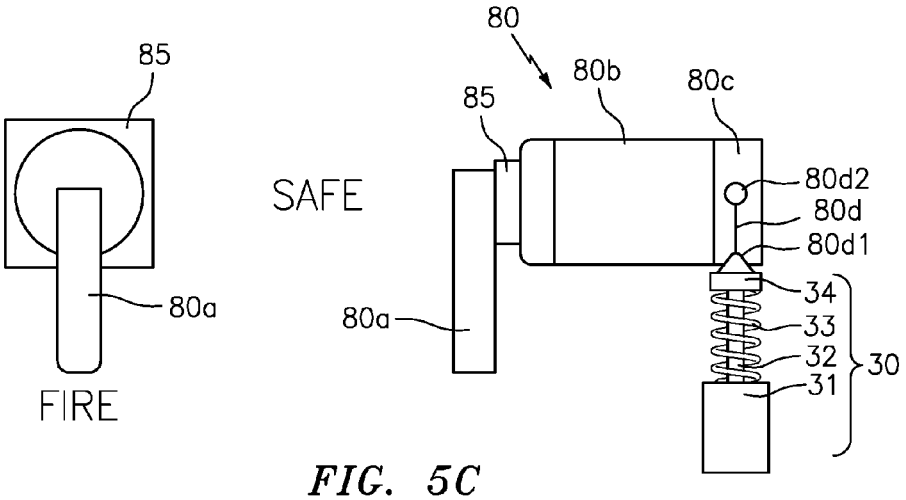
FIG. 5C is another exemplary cutout view of the operation of the replacement selector switch of the illustrative firearm locking device in operation, in accordance with the another embodiment.

As shown best in FIGS. 5B and 5C, the replacement selector switch 80 can include a first end 80*a* in the form of a thumb lever that is connected to an elongated notched-cylindrical member 80*b* that extends across the receiver body and terminates into a contoured second end 80*c* having a transverse groove 80*d* with a dimple 80*d*1 and 80*d*2 along each end. Elements 80*a*-80*d*2 including substantially identical shapes and sizes to elements 8*a*-8*d*2, respectively, so as to allow for uniform replacement and installation of the same as either an aftermarket component or in the manufacture of a new firearm/receiver as an OEM component.

In the preferred embodiment, the torque limiter 85 can be positioned between the thumb lever 80*a* and the elongated cylindrical member 80*b*, and can function to allow normal operation of the selector switch as described above with regard to FIGS. 3A-3G. However, when the device 20 is in the locked/extended state and a force F exceeding a predetermined threshold is applied onto the thumb lever 80*a* (FIG. 5B), the torque limiter 85 can engage, so as to allow the thumb lever to rotate but the remaining portions of the selector switch 80 to remain in the locked position (FIG. 5C).

It is preferred that the torque limiter can be reusable in nature, by simply rotating the thumb lever 80*a* back to the SAFE position. One suitable example of a torque limiter for use herein includes the model 3744 servo saver that is commercially available from Traxxas®. Of course, any number of known devices capable of preventing an over torque situation such as various spring loaded clips, friction plates and/or shear pins, for example, may also be utilized herein.

As described herein, one or more elements of the firearm locking device 20 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A locking device for use with a firearm, said locking device comprising:

a handgrip that includes an elongated member having a top end, an outside surface, and an interior space, said handgrip including a shape and size that is suitable for engaging a firearm receiver having a selector switch;

a switch engagement unit that is in communication with the interior space of the handgrip and is configured to selectively engage a portion of the selector switch located inside the firearm receiver to which the handgrip is secured; and a control system that is communicatively linked with the switch engagement unit, said control system including functionality for transitioning the engagement unit between a retracted position or an extended position upon verifying a user identity, wherein in the retracted position, the selector switch is manually transferrable between a SAFE position and a FIRE position, and in the extended position, the selector switch is locked in the SAFE position.

2. The device of claim 1, wherein the switch engagement unit comprises:

a motor that is secured within the interior space of the handgrip;

a piston having a first end that is in communication with the motor, and a second end that extends through the top end of the handgrip;

a spring that is secured about a distal portion of the piston; and a detent that is secured along a distal end of the spring, said detent including a shape and size that is suitable for engaging each of a first and second dimple on the selector switch, wherein the first dimple corresponds to a SAFE position of the selector switch, and the second dimple corresponds to a FIRE position of the selector switch.

3. The device of claim 2, wherein the motor and the piston comprise a linear actuator.

4. The device of claim 2, wherein the motor is configured to transition the piston between a retracted position and an extended position.

5. The device of claim 4, wherein in the retracted position, the piston is not in physical contact with the detent, and the detent and spring are in communication with the selector switch so as to allow the switch to freely transition between the SAFE position and the FIRE position.

6. The device of claim 4, wherein in the extended position, the piston is in physical contact with the detent, and the detent is secured within the first dimple so as to lock the selector switch in the SAFE position.

7. The device of claim 4, wherein the switch engagement unit is configured to automatically transition the selector switch from the FIRE position to the SAFE position when in the piston is in the extended position.

8. The device of claim 1, further comprising:

an RFID interrogator that is positioned within the interior space of the handgrip.

9. The device of claim 8, further comprising:

an RFID tag that is not located within the interior space of the handgrip and that is configured to communicate with the RFID interrogator.

10. The device of claim 9, wherein the control system includes functionality for instructing the engagement unit to transition to the retracted position when the RFID interrogator and RFID sensor are in communication.

11. The device of claim 9, wherein the control system includes functionality for instructing the engagement unit to transition to the extended position when the RFID interrogator and RFID sensor are in communication.

12. The device of claim 1, further comprising:

a replacement selector switch having a thumb lever, an elongated cylindrical member, and a torque limiter positioned therebetween, said replacement selector switch including a shape and size that is suitable for replacing the selector switch of the firearm receiver and for transitioning the same between a SAFE position and a FIRE position.

13. The device of claim 1, further comprising:

a user interface that includes at least one of an RFID interrogator that is positioned within the interior space of the handgrip, a biometric authentication unit, or a combination lock.

14. A locking device for use with a firearm, said locking device comprising:

a selector switch having a thumb lever, an elongated cylindrical member, and a torque limiter positioned therebetween, said selector switch including a shape and size that is suitable for being positioned within a firearm receiver and for transitioning between a SAFE position and a FIRE position;

a handgrip that includes an elongated member having a top end, an outside surface, and an interior space, said handgrip including a shape and size that is suitable for engaging the firearm receiver having the selector switch;

a switch engagement unit that is in communication with the interior space of the handgrip and is configured to selectively engage a portion of the selector switch located inside the firearm receiver to which the handgrip is secured; and a control system that is communicatively linked with the switch engagement unit, said control system including functionality for transitioning the engagement unit between a retracted position or an extended position upon verifying a user identity, wherein in the retracted position, the selector switch is manually transferrable between a SAFE position and a FIRE position, and in the extended position, the selector switch is locked in the SAFE position.

15. The device of claim 14, wherein the switch engagement unit comprises:

a motor that is secured within the interior space of the handgrip;

a piston having a first end that is in communication with the motor, and a second end that extends through the top end of the handgrip;

a spring that is secured about a distal portion of the piston; and a detent that is secured along a distal end of the spring, said detent including a shape and size that is suitable for engaging each of a first and second dimple on the selector switch, wherein the first dimple corresponds to the SAFE position of the selector switch, and the second dimple corresponds to the FIRE position of the selector switch.

16. The device of claim 15, wherein the motor is configured to transition the piston between a retracted position and an extended position.

17. The device of claim 16, wherein in the retracted position, the firearm selector switch is positionable in both the SAFE position and the FIRE position, and in the extended position, the firearm selector switch is locked in the SAFE position.

18. The device of claim 17, wherein the torque limiter is configured to transition to an engaged position upon receiving a force greater than a predetermined amount.

19. The device of claim 15, wherein in the engaged position, the detent is secured within the first dimple so as to lock the selector switch in the SAFE position, and an orientation of the thumb lever does not correspond to the position of the selector switch.

20. A locking device for use with a firearm, said locking device comprising:

a handgrip that includes an elongated member having a top end, an outside surface, and an interior space, said handgrip including a shape and size that is suitable for engaging a firearm receiver having a selector switch;

a switch engagement unit that is in communication with the interior space of the handgrip and is configured to selectively engage a portion of the selector switch located inside the firearm receiver to which the handgrip is secured;

a control system that is communicatively linked with the switch engagement unit; and a user interface having an RFID interrogator that is configured to receive an instruction to transition the engagement unit between a retracted position and an extended position, wherein in the retracted position, the selector switch is manually transferrable between a SAFE position and a FIRE position, and in the extended position, the selector switch is locked in the SAFE position.

* * * * *